United States Patent [19]

Ivey et al.

[11] 4,447,035

[45] May 8, 1984

[54] JOINING CONCRETE FORM PANELS TO CAST AN INSIDE CORNER WALL STRUCTURE

[75] Inventors: H. Grady Ivey, Jacksonville; D. Leonard Sprouse, Mandarin, both of Fla.

[73] Assignee: Strickland Systems, Inc., Jacksonville, Fla.

[21] Appl. No.: 428,855

[22] Filed: Sep. 30, 1982

[51] Int. Cl.[3] ..... B28B 7/30

[52] U.S. Cl. ..... 249/194; 249/27; 249/180; 249/184; 249/185; 249/192

[58] Field of Search ..... 249/185, 194, 27, 178, 249/180, 184, 190, 192

[56] References Cited

U.S. PATENT DOCUMENTS

| | | | |
|---|---|---|---|
| Re. 14,807 | 2/1920 | McKay . | |
| 1,312,462 | 8/1919 | Wales . | |
| 1,498,651 | 6/1924 | Folwell | 249/185 |
| 1,538,496 | 5/1925 | Wells . | |
| 1,554,420 | 9/1925 | Donley . | |
| 2,206,493 | 7/1940 | Whatling . | |
| 2,272,659 | 2/1942 | Daley . | |
| 2,352,783 | 7/1944 | Geer . | |
| 2,543,892 | 3/1951 | Carpenter . | |
| 2,826,801 | 3/1958 | Imonetti et al. . | |
| 2,827,683 | 3/1958 | Benart et al. | 249/180 |
| 2,896,300 | 7/1959 | Arrighini et al. . | |
| 3,131,453 | 5/1964 | Stockton et al. . | |
| 3,244,395 | 4/1966 | Arrighini . | |
| 3,353,782 | 11/1967 | Zastrow | 249/152 |
| 3,558,095 | 1/1971 | McNiel | 249/27 |
| 3,680,824 | 8/1972 | Kesting | 249/178 |
| 3,822,853 | 7/1974 | Shelley . | |
| 3,853,452 | 12/1974 | Delmonte . | |
| 3,934,808 | 1/1976 | Aizawa . | |
| 3,989,439 | 11/1976 | Schmitzberger | 249/178 |
| 3,993,720 | 11/1976 | Burdett | 249/180 |
| 4,088,296 | 5/1978 | Armas . | |

*Primary Examiner*—Thomas P. Pavelko
*Assistant Examiner*—James C. Housel
*Attorney, Agent, or Firm*—Banner, Birch, McKie & Beckett

[57] ABSTRACT

For casting a concrete inside corner wall structure, the corner is defined by a corner member to extend lengthwise of the corner with the adjacent edges of a pair of form panels that are disposed generally perpendicular to each other being butted against the outer edges of the corner member and a control unit is interconnected with the form panels and the angle member to retain this relationship between the panels and angle member incident pouring and hardening of the concrete. The control unit has actuator means associated therewith operable to move the panel edges into abutment with the outer edges of the angle member prior to concrete pouring and to strip both the form panels and the angle member from the hardened concrete structure.

2 Claims, 7 Drawing Figures

JOINING CONCRETE FORM PANELS TO CAST AN INSIDE CORNER WALL STRUCTURE

BACKGROUND OF THE INVENTION

This invention relates generally to assembling concrete form panels for use in casting concrete wall structures. More particularly it relates to improvements in apparatus provided to form the corners of a concrete cast wall structure and especially inside corners.

In the prior art, many different proposals have been offered with respect to form work and assembling such form work into functional units for concrete construction. Accordingly various structures have been suggested for use in positioning concrete form panels as required in casting the inside corner of a concrete wall structure. Forming such inside corners is necessary in providing concrete shafts, such as elevator shafts, and stairwells in building construction.

Ideally the finished inside corner is to be smooth and free from joint lines as might be created by the surface character of the form panel or other elements against which the concrete is cast. Importantly, the structure or apparatus utilized to cast the concrete inside corner thereagainst should be simple and involve a minimum number of structural elements. Certainly it is a disadvantage for the form panel support structure to involve use of a variety of separate detached or detachable elements which would be subject to being separated or lost to prevent reuse of the structure at different site locations.

The prior art structures have generally failed to permit obtaining all of the above mentioned advantages and to avoid the disadvantages outlined.

Accordingly one of the essential objects of this invention is to provide form panel apparatus for casting an inside corner structure which will render it possible to form the concrete wall structure with a smooth inner surface at and adjacent the corner with the apparatus being composed of a relatively few simple parts which are capable of being readily assembled and disassembled.

A principal object of the invention is the provision of an inside corner concrete form panel support structure with a minimum of individual parts such that there is less likelihood of any of the parts being lost or separated for the installation at which they are needed.

Another object of the invention is to provide a corner form panel structure which is adapted to extend across the space between the adjacent edges of wall forming panel sections at the corner of a shaft or other inside corner wall structure, in which a corner forming member has angularly related outer edges respectively overlapping and interengaging with the inner wall forming surfaces of the panel sections with a control unit operable to clamp the overlapping edges of the corner forming member firmly against the wall forming surfaces of the panel sections.

Another object is to provide an inside corner structure for concrete form panel support which provides the requisite strength for holding the parts incident pouring and hardening of the concrete and also has sufficient force generating capability to enable stripping of the adjacent corner form panels and corner angle member from the hardened concrete inside wall corner.

Another object is to provide a control unit for an inside corner structure as described above in which the form panel sections and the corner forming member are elongated and extend at right angles to one another to define the inside corner.

Another object of the invention is to provide a corner forming structure in which the adjacent form panels that are engaged with the angle member at the corner to be cast are positively controlled by a control unit utilizing four bar linkage members to move the panels perpendicularly away from the hardened concrete wall structure.

SUMMARY OF THE INVENTION

Briefly the invention involves concrete form panel apparatus for use in casting a concrete inside corner wall structure. This apparatus employs an elongate member defining an outwardly facing corner angle which extends lengthwise of the corner to be cast and provides outer edges facing normal to each other while a pair of form panels, deposed generally perpendicular to each other, have adjacent edges which are moved into abutment with the outer edges of the member prior to carrying out the concrete pouring operation. The member and pair of form panels are all interconnected by a control unit which has an actuator operable to move the adjacent edges of the panels into abutment with the outer edges of the corner member. This control unit, and specifically the actuator means thereof, also operates to strip both of the form panels and the corner angle member from the concrete after it has hardened. Positively controlled movement of the form panels and corner angle member relative to each other is acheived by the control unit being connected to the form panels by four-bar linkages and the control unit also having a reciprocably moveable rod element which is rigidly secured to the inside of the corner angle member and extends inwardly from the corner to be cast between the adjacent edges of the form panels to the point where it is connected with the body of the control unit for the element to be driven axially relative to the body mechanically, hydraulically or otherwise.

In utilizing the apparatus in an environment where four inside corner unit assemblies are to be provided, such as is necessary in forming the four inside corners of a shaft ideally the four corner unit assemblies will be actuated to their closed and open conditions simultaneously.

BRIEF DESCRIPTION OF THE DRAWINGS

The foregoing objects, as well as others, will become apparent through consideration of the following detailed description of the invention given in connection with the accompanying illustrations on the drawings in which.

DETAILED DESCRIPTION OF ILLUSTRATIVE EMBODIMENTS

Figure 1:
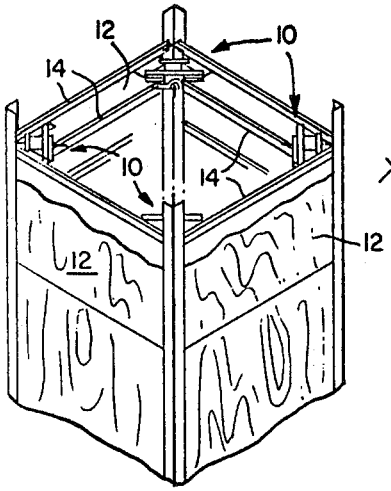
FIG. 1 is a partial diagramatic perspective view showing four corner units assembled with concrete form panels about which a concrete shaft wall structure would be cast.

FIG. 1 shows four corner units 10 of the instant invention assembled with form panels 12 for utilization. Thus, there are four corner units 10 associated with four concrete form panels 12, each form panel defining one wall of a concrete shaft which would be cast around the assembly. Each form panel 12 may be suitably constructed, as is conventional, from one or more sheets of plywood. Likewise, as usual in the art, the individual form panels 12 are reinforced by horizontally extending, spaced walers 14. Although not shown in FIG. 1, the walers 14 may in turn be strengthened by connecting thereto horizontally spaced stiffeners or strongbacks that extend vertically of the walers 14.

Figure 7:
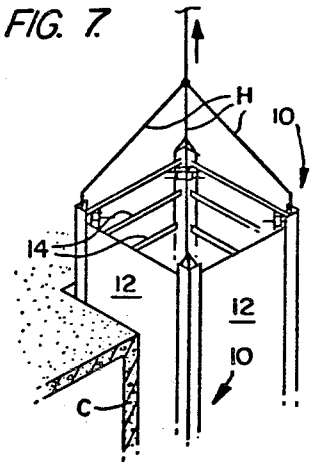
FIG. 7 is a diagramatic perspective view showing four corner units in assembled form to be withdrawn from a hardened concrete shaft wall structure as an assembly.

Whereas FIG. 1 shows the assembly of four corner units 10 with appropriate form panels 12, FIG. 7 illustrates the manner in which the assembly of FIG. 1, after use in casting the inner concrete wall surface of a shaft may have a cable harness H attached to the upper four corners of the assembly for lifting it out of the hardened concrete shaft that was previously poured.

Figure 2:
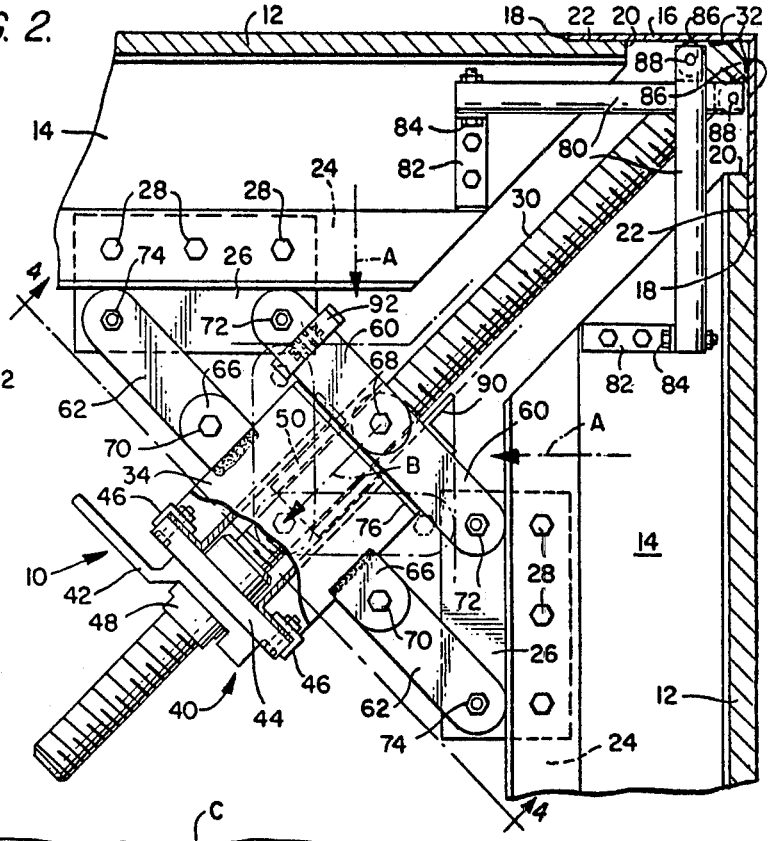
FIG. 2 is a plan view partially in section, of a corner unit associated with form panels in closed condition for shaping an inside corner structure.
Figure 3:
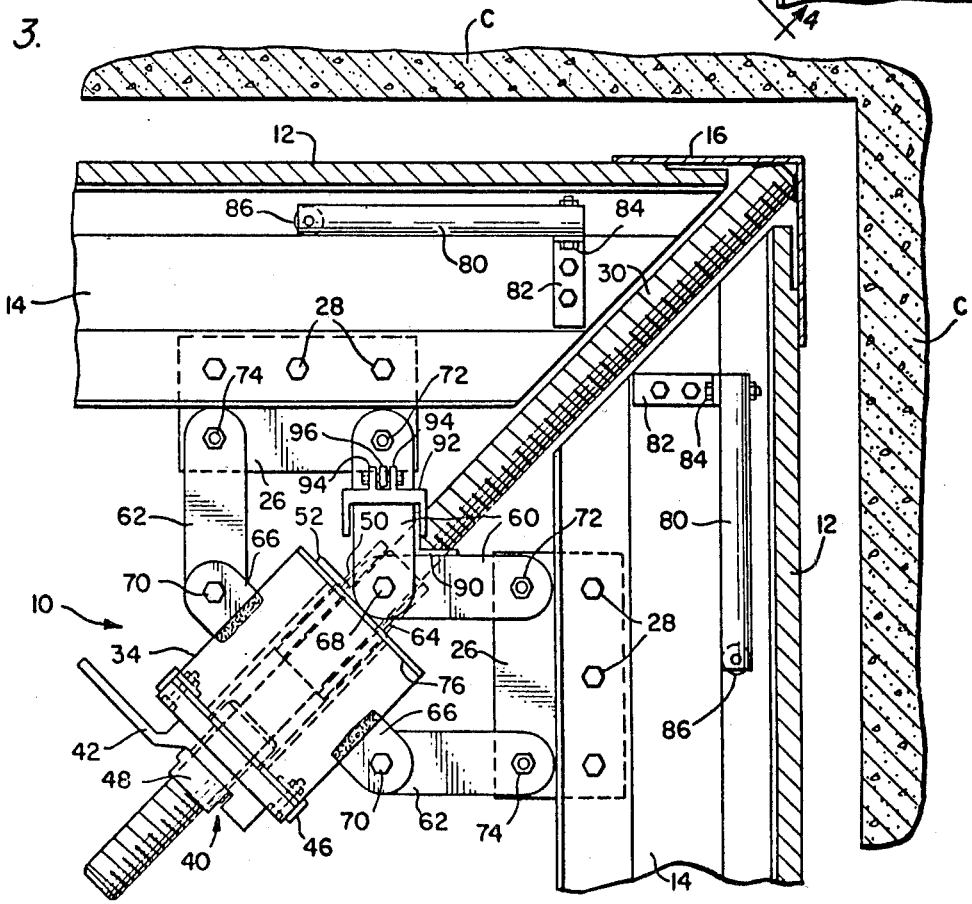
FIG. 3 is a view similar to FIG. 2 but showing the corner unit and form panels in open condition.

FIGS. 2 and 3 on the drawings show a corner unit 10 connected to the adjacent edges of form panels 12 to make use of the unit. FIG. 2 shows the unit 10 in closed condition in readiness for concrete to be poured exteriorly thereof to create an inside corner wall structure whereas FIG. 3 shows a corner unit 10 in open condition where the form panels and unit have beend stripped from the hardened inside corner wall structure C. Thereafter, the unit and associated form panels are removed and utilized at a new location.

A corner member 16 is provided on corner unit 10 to define an outwardly facing corner angle. Angle member 16 is elongated to extend lengthwise of the corner to be cast with the concrete being poured outwardly of the corner unit 10 and associated form panels 12. The member 16 provides outer edges 18 which face normal to each other. In turn, the adjacent edges 20 of perpendicular form panels 12 are provided with longitudinal grooves 22. As shown in FIG. 2, with the corner unit 10 in its closed condition the outer edges 18 of angle member 16 are nested into the respective grooves 22 on edges 20 so that the outer edges 18 are abutted with the adjacent edges of the form panels 12. Accordingly, the outer surfaces of these form panels and outer surfaces of angle member 16 conjointly define an outwardly facing smooth corner angle surface against which the poured concrete is cast and thereafter hardens.

It is contemplated that plywood sheets may form the panel surfaces against which the concrete is cast and walers 14 are attached to this plywood sheeting to complete to form panel 12.

In the illustrated embodiment the form panels 12 utilize walers 14 which preferably are formed from extruded aluminum. It is to be recognized that walers 14 may also be provided by elongated wooden members, such as 2×4s, as are used in conventional concrete form panel construction work. In using extruded aluminum lengths to provide walers 14, the waler cross-section may suitably be formed with a cavity 24. A mounting plate 26 may be snuggly received in cavity 24 and bolted to the waler 14 by bolt and nut connectors 28, three such connectors being shown affixing each plate 26 to its waler 14. A plate 26 is fastened to each of the adjacent ends of walers 14 as shown. It may be noted that, as illustrated, the adjoining ends of walers 14 are cut off at a bevel to facilitate movement of the walers 14 and panels 12 from the closed condition shown in FIG. 2 to the open condition shown in FIG. 3. Of course, beveling the ends of walers 14 is not necessary as long as their end configuration does not conflict with movement of any other operating components of the corner unit 10.

Each corner unit 10 has a control element 30. In the illustrated embodiment element 30 is provided by an elongated threaded screw. One end of the threaded screw element 30 is secured at 32 as by welding, to the inner wall surface of corner angle member 16. Thus screw element 30 is fixed against rotation to extend at an angle of 45 degrees relative to the 90 degree angle between the outwardly facing surfaces of member 16.

Screw element 30 extends inwardly from corner angle member 16 between the adjacent ends of form panels 12 and ends of walers 14 to pass through a body 34, forming with element 30 part of a control unit that is a component of corner unit 10. In operation of the corner unit, reciprocal movement of body 34 relative to element 30 is necessary to carry out the actions of unit 10 in first moving the adjacent edges of form panels 12 into abutment with the outer edges 18 of corner angle member 16 and secondly in stripping both of the form panels and the corner angle member from the concrete structure after pouring and hardening of the concrete exteriorly of the form panels 12 and member 16.

In the preferred embodiment primarily shown in FIGS. 2 through 5, the movement of body 34 reciprocally relative to control element 30 is achieved by utilization of an actuator means in the form of device 40. Device 40 consists of a clamping member 42 which is pivotally supported on base 44 of the device. In turn the device is clamped at 46 to body 34 of the control unit. A centrally grooved anchor nut 48 in held by the clamping member 42 against axial movement relative to the base 44 of device 40 when the clamping member is closed as shown in FIGS. 2 and 3. The anchor nut 48 is internally threaded and is threadably engaged with the screw element 30. The end of anchor nut 48 is provided with flat portions to accomodate engagement of nut 48 by an appropriate wrench to enable turning the nut relative to screw element 30. Thus the nut can be screwed on or off element 30 to move the control unit body 34 axially along control unit element 30.

The detailed structure of device 40 is not illustrated on the drawings since its construction forms no part of the invention herein. For a fuller understanding of its construction and operation, reference may be made to U.S. Pat. No. 4,044,986, issued August 30, 1977. The utilization of device 40 in the instant invention and its function herein is similar to that disclosed in this patent. Certainly this is true insofar as its releasable clamping action is utilized by engagement of centrally grooved anchor nut 48 with threaded screw element 30 to achieve inward or outward movement of control unit body 34 relative to element 30.

Figure 6:
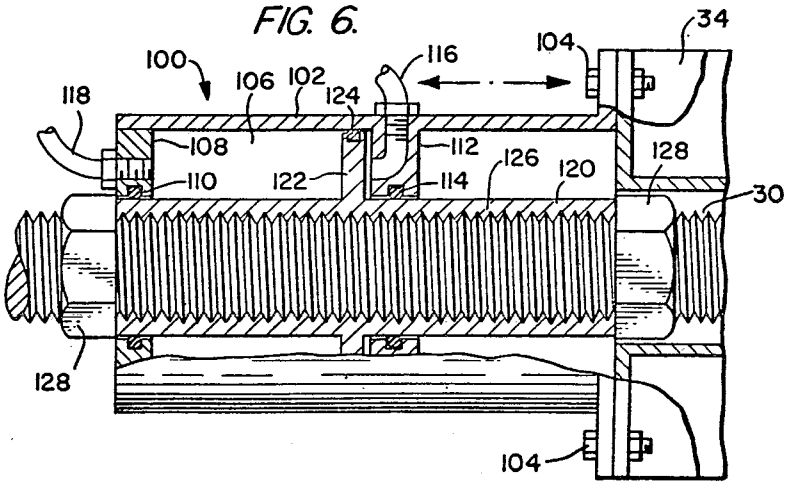
FIG. 6 is a longitudinal sectional view of a hydraulic actuator device.
Figure 5:
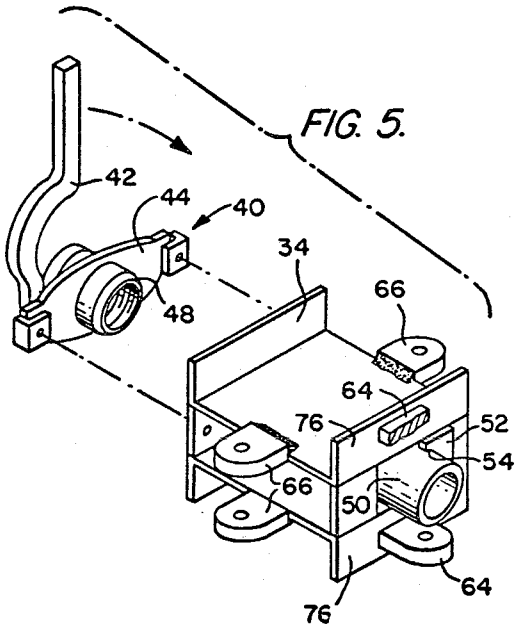
FIG. 5 is a perspective view of the control unit body and actuator devive spaced therefrom.

Mention may be made at this point of an alternative actuator means which may be employed as a substitute for device 40. As shown in FIG. 6, a hydraulic actuator device may be used in place of device 40 to achieve the same reciprocal movement of the control unit body 34 relative to threaded screw element 30. Detailed description of the hydraulic actuator shown in FIG. 6 will be given subsequently.

Figure 4:
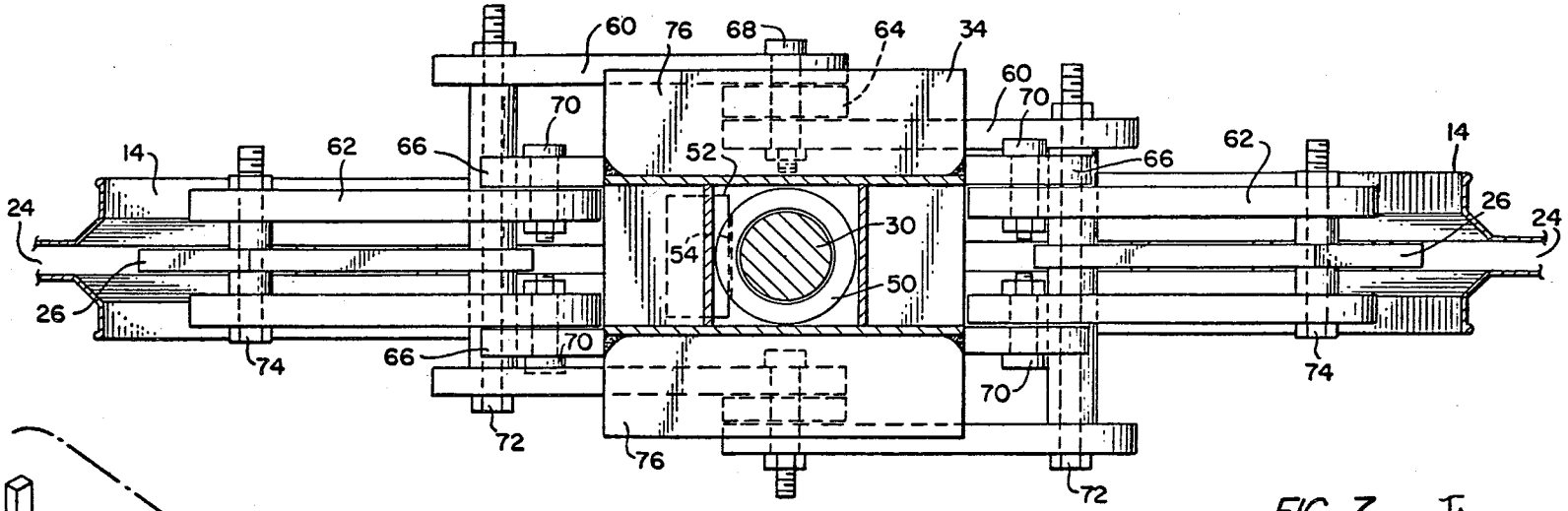
FIG. 4 is a sectional view taken on line 4—4 of FIG. 2.

The body 34 of the control unit is guided and driven in its movements back and forth along threaded element 30 by the anchor nut 48 associated with actuator device 40. To further assist in this guided movement, a sleeve 50 is mounted in the end of body 34 opposite the anchor nut 48. This sleeve 50 slidably receives the element 30 therewithin. The sleeve is appropriately restrained against longitudinal or rotational movement relative to the control unit body 34 by a key 52 on the body 34 which is received in a groove 54 formed in the outer periphery of sleeve 50 all as best shown in FIG. 4.

Referring again to FIGS. 2 and 3 the control unit has its body 34, that is slidably received in threaded element 30 interconnected by four bar linkage means to each of the plates 26. As previously described, each plate 26 is fastened by connectors 28 to one of the adjacent ends of the walers 14 where the walers approach the corner to be cast in concrete. Each of the sets of these linkage means is provided by a pair of forward upper and lower links 60 which are disposed forwardly or toward the corner of the corner angle member 16 and upper and lower links 62 which are disposed rearwardly or outwardly of the links 60.

The end of each of the links 60 and 62 that is adjacent the control unit body 34 is pivotally connected to such body. Thus, two ears 64 are fixed, as by welding, to the forward end of the control unit body 34. The ears 64 provide a pivot axis for the ends of links 60, this axis being vertically aligned with the axis of the threaded element 30 as shown in FIGS. 2 and 3. Likewise a pair of vertically spaced ears 66 is fixed to the opposite side edges of the body 34, as by welding, to pivotally connect the ends of links 62 to the body 34. Two pairs of ears 66 are provided, one on each side of the body 34 to accomodate the two pairs of links 62. The two pairs of ears 66 provide spaced parallel pivot axes for the ends of links 62. The relationship of the ears 64 and 66, as mounted on the body 34 of the control unit, may be viewed in FIG. 5.

The ends of links 60 adjacent body 34 are pivotally connected to the spaced ears 64 by pivot pins 68. Likewise the ends of links 62 disposed adjacent the control unit body 34 are pivotally connected to the spaced pairs of ears 66 by pins 70. Of course each of the pins 68 and 70 is suitably retained in position to permit free pivotal movements of the links retained thereby relative to the ears secured to the body 34. The location of the two pins 68 and four pins 70 relative to the body 34 may best be seen on FIG. 4 on the drawings.

The ends of each of the links 60 and 62 remote from the control unit body 34 are each pivotally connected to one of the plates 26 that is secured by fasteners 28 to the walers 14. Thus the remote ends of links 60 are pivotally connected to the respective plates 26 by pins 72 and the remote ends of link 62 are pivotally connected to the respective plates 26 by pins 74. Again it will be appreciated that the pins 72 and 74 are retained in place in such a manner that free pivotal movement between the links 60 and 62 relative to the respective plates 26 will be permitted. The relation of pins 72 and 74 to the respective plates 26 may best be viewed on FIG. 4.

Referring to FIGS. 2 and 3 it will be recognized that each combination of a link 60 and link 62 with the pivotal connections as illustrated, forms a four bar linkage interconnecting the control unit body 34 with one end of one of the walers 14. Thus the spacing of pins 68 and 70 and the pins 72 and 74 dispose the links 60 parallel to the links 62. In the closed condition of the corner unit 10 that is shown on FIG. 2, the links 60 and the links 62 are respectively aligned. By the same token in the open condition of the corner unit 10 as shown in FIG. 3 the four bar linkages formed by links 60 and 62 have been collapsed to dispose the pairs of links 60 and links 62 at right angles to each other.

In the closed condition for the corner unit 10, as illustrated on FIG. 2, the corner angle member 16 is drawn into be positioned with its outer edges 18 abutting the adjacent edges of the form panels 12 at the corner of the wall structure that is to be cast. The anchor nut 48 of the actuator device 40 has been threaded down onto screw element 30 to draw the member 16 toward the adjacent edges of form panels 12 thereby pressing the control unit body 34 toward the corner and compelling the links 60 and 62 to assume the position as shown on FIG. 2.

It may be noted that a flange 76 forming a part of control unit body 34 is so positioned that the links 60 are prevented from moving beyond the straight aligned position such as shown in FIG. 2. Thus with anchor nut 48 firmly tightened down on screw element 30 the corner angle member 16 and the adjacent ends of the form panels 12 are retained in proper position for pouring concrete outwardly of the corner member 16 and form panels 12. Of course, the force from the anchor nut 48 is transmitted through the device 40 to the body 34 of the control unit to achieve the above described condition of the apparatus.

Once the concrete has been poured and thereafter has hardened to form the inside corner wall structure it is, of course, necessary to strip both the form panels 12 and the angle member 16 from the concrete wall structure surface. In carrying out this operation the apparatus is moved to the opened condition as shown in FIG. 3. To achieve this condition the anchor nut 48 is backed off by threading it off of the screw element 30. This action, acting through the device 40 attached to control unit body 34, pulls the body back away from the concrete corner wall structure. The force applied by anchor nut 48 acting on screw element 30 tends to push the corner member 16 against the hardened concrete wall structure corner. In moving to the open condition, the four bar linkages, formed by links 60 and 62, collapse to the condition as shown in FIG. 3. In doing so the respective form panels 12 are stripped away from the cast concrete C by being drawn perpendicularly from the hardened concrete wall surface. Thereafter the anchor nut 48 is threaded in the opposite direction to draw the threaded screw element 30 with the corner member 16 affixed thereto rearwardly to strip the corner member 16 from the cast concrete C.

In moving from the closed condition as shown in FIG. 2 to the opened condition for the apparatus as shown in FIG. 3, holding means described hereinafter are provided to retain the components in proper operating relationship incident threading of the anchor nut 48 on element 30 away from and thereafter toward the corner member 16 which, of course, acts on such member through the elongated screw element 30.

With the corner unit 10 in its closed condition as shown in FIG. 2, the apparatus stands ready for pouring concrete around the exterior thereof to cast an inside corner wall structure. After hardening of the concrete, the form panels 12 and corner member 16 must be stripped from the hardened concrete wall. Incident this stripping operation, the form panels 12 with walers 14 move perpendicularly inwardly in the directions of arrows A. Then the elongated threaded element 30 carrying corner member 16 is drawn back from the cast inside corner wall in the direction of arrow B.

To assure separation between the outer edges of angle member 16 and the adjacent edges of form panels 12 when the panels are being stripped, a pair of travel rods 80 are provided, one being pivotally fixed to the end of each of the walers 14 where the walers 14 and panels 12 approach the inside corner wall structure. To provide this pivotal mounting, a bracket 82 may be approriately bolted or otherwise fastened to the web of the waler 14 with each bracket 82 carrying a pivot pintle 84 that may be provided by a bolt and nut, the bolt being passed through openings provided in the end of the travel rod 80 so as to achieve pivotal mounting of the travel rod on the end of the waler 14. The end of each travel rod 80 remote from its pivotal mounting by pintle 84 on bracket 82 is provided with a roller 86 supported to project slightly beyond the end of travel rod 80 by being rotatably carried on a pin 88.

When the form panels 12 are to be stripped from the hardened concrete wall structure the travel rods 80 are pivoted into the positions as shown in FIG. 2. It will be noted that purely for illustrative purposes the left travel rod 80 shown in FIG. 2 is mounted on bracket 82 so that it extends horizontally for its roller 86 to rotatably engage the inner surface of one wall of corner angle member 16. The bracket 82 carrying the other travel rod 80 disposes such rod to extend horizontally over and above the first mentioned travel rod with the roller 86 of this other travel rod rotatably engaging the inner wall of the other leg of corner angle member 16. When the anchor nut 48 is screwed outwardly on threaded element 30, control unit body 31, through the action of the four bar linkages formed by links 60 and 62, will draw the two form panels 12 and their walers 14 inwardly in the directions of arrows A to move perpendicularly away from the hardened concrete wall. Incident this movement of the form panels 12, the travel rods 80 will be carried along and rollers 86 will roll along the inner surfaces of the legs of corner angle member 16. Thus, the travel rods 80 assure that the angle member 16 is retained in its position within the corner of the hardened concrete wall structure so as not to move with this initial movement of the form panels 12 away from the hardened wall structure. It should be noted however that inherently the forces applied by rotation of anchor nut 48 on threaded element 30 as the nut is threaded back off the element act to force element 30 and angle member 16 carried thereby more firmly into engagement with the hardened concrete wall corner. This force is transferred through control unit body 34 to the four bar linkages in stripping form panels 12 off of the hardened wall surface.

Once the form panels 12 have been fully stripped and withdrawn from the hardened wall surface the four bar linkages formed by links 60 and 62 will have assumed the positions shown in FIG. 3. Thereupon it is desired that the angle member 16 be stripped from the corner of the hardened concrete wall structure and fully withdrawn to assume the position, relative to the form panels 12, shown in FIG. 3.

With the form panels 12 fully withdrawn and angle member 16 still disposed in the hardened concrete inside corner, the travel rods 80 will be pivoted on pintles 84 by carried by brackets 82 to their retracted positions as shown in FIG. 3, with the rods 80 lying along and extending inwardly of the walers 14. In this condition of the apparatus, the anchor nut 48 is rotated on screw element 30 in the opposite direction to return it onto the element and toward the corner where angle member 16 is located. This action through nut 48 on device 40 and control unit body 34 tends to return the four bar linkages of links 60 and 62 back to their relationship as shown in FIG. 2. However, there are provided associated with at least the two upper links 60, a retaining means to keep links 60 in their right angle position, preventing them from moving from this state. Inherently this retaining means also acts to keep the links 62 in their relationship to each other as shown in FIG. 3.

The retaining means consists of, in the embodiment illustrated, a short tab 90. This tab is simply shown in the form of a short length angle. It is appropriately affixed by welding to one edge of right link 60 as shown in FIGS. 2 and 3. The upper or left link of the pair of links 60 as shown in FIGS. 2 and 3 is provided with a pivotally mounted C-shaped retainer 92. Retainer 92 has parallel legs 94 extending from the midportion thereof which are pivotally engaged by a pin carried by an ear 96 that is welded on the upper surface of the left hand link as shown on FIGS. 2 and 3. Retainer 92 may be swung from an upper or inactive position as shown in FIG. 2 to an active retaining position as shown in FIG. 3. In the inactive position the legs of the C-shaped retainer 92 extend upwardly. As the links 60 of the four bar linkages move to the position shown in FIG. 3 the tab 90 on one link 60 will be moved into the position relative to the other leg 60 as shown in FIG. 3. Thereupon the retainer 92 may be swung on ear 96 down into the retaining position. In this retaining position the C-shaped retainer 92 clamps the tab 90 against the side of the other link 60 and serves to prevent movement of the links 60 from the right angle relationship as shown in FIG. 3.

With retainer 92 disposed as shown in FIG. 3 the anchor nut 48 may be threaded back onto element 30 to apply force in drawing element 30 and corner member 16 away from the hardened concrete corner to strip the corner member from the wall structure. This force acting to pull corner member 16 and element 30 back when transmitted to body 34 of the control unit will not result in the links 60 or 62 returning toward the position shown in FIG. 2 because the retainer 92 serves to prevent the links of the four bar linkages from moving away from their 90 degrees disposition relative to each other.

By manipulating the anchor nut 48 relative to the threaded screw element 30 by the components of the apparatus may be snuggly drawn into their relationship as shown in FIG. 3.

Ideally the corner units 10 are simultaneously and equally actuated from all four corners of the cast concrete shaft so that all four form panels 12 and all four of the corner angle member 16 are conjointly drawn back in being stripped from the hardened wall surface of the now cast shaft. In this collapsed or retracted condition where all of the corner units are in their opened condition as shown in FIG. 3, the entire assembly may have the corners thereof attached to a harness H, as shown in FIG. 7, and then the entire assembly of corner units 10 with form panels 12 lifted from the shaft or, if desired, raised to a new location where a further portion of a concrete shaft wall structure is to be cast. When the corner units 10 are to be reextended to their closed position, obviously the retainer 92 is swung from the position shown in FIG. 3 to its upstanding position on the link 60 to which it is attached. Thereupon the corner unit 10 is in condition to have the anchor nut 48 loosened on element 30, the angle member 16 positioned at the desired location for the inside corner to be cast and thereupon anchor nut 48 threaded onto element 30 to move the form panels 12 into the proper relationship with the angle member 16 as shown in FIG. 2 for the casting of a further inside corner wall structure where desired.

Whereas the four bar linkages utilizing the pairs of links 60 and 62 are advantageous in obtaining positive and precise control of movements of the apparatus components relative to each other between the opened condition and the closed position it is to be understood that within the concepts of this invention other appropriate mechanisms may be employed in achieving the necessary controlled movements between the form panels and corner member at the inside corner wall structure to be cast.

As shown in FIG. 6, a suitable hydraulic actuator device 100 may be used in place of the actuator device 40. The hydraulic actuator device 100 is shown formed with a cylindrical housing 102 that is appropriately bolted at 104 to the control unit body 34 by means of a flange on the housing 102. A chamber 106 to accommodate hydraulic actuating fluid is defined within housing 102 by an annular wall 108 secured at one end of the housing with a seal 110 mounted on the inner perimeter of the annular wall 108. The opposite end of chamber 106 within housing 102 may be defined by an inwardly extending annular wall 112 having a seal 114 mounted on the inner periphery thereof. Connections for introducing and/or exhausting hydraulic fluid are provided communicating with chamber 106 by lines 116 and 118.

A sleeve piston 120 is shown mounted within housing 102 of actuator device 100. Piston 120 has a smooth cylindrical surface which sealingly cooperates with seals 110 and 114 to prevent escape of hydraulic fluid from chamber 106. Piston 120 is provided with a radially extending cylindrical wall 122 having an appropriate seal 124 disposed around the outer edge thereof which sealingly engages with the inner wall of cylindrical housing 102.

It will be appreciated that with the introduction of hydraulic fluid under pressure through line 116 and exhausting fluid through line 118 the piston 120 will be driven to the left, as shown in FIG. 6. Likewise by introducing hydraulic fluid pressure through line 118 and exhausting fluid through line 116 the piston 120 by reason of the fluid acting on wall 122 will urge piston 120 toward the right, as shown in FIG. 6.

The hydraulic actuator device 100 is to be mounted on control unit body 34 in place of actuator device 40 with the elongated threaded screw element 30 passing through the interior of the device 100. The sleeve piston 120 of device 100 is internally threaded at 126 to threadingly mate with the threads on element 30. Nuts 128 may be provided, threaded onto element 30 at the ends of sleeve piston 120, to lock the piston in its desired location on element 30 so as to move with the screw threaded element 30 in accordance with the flow of hydraulic fluid relative to chamber 106 through lines 116 and 118.

It is to be understood that movements comparable to those achieved with the mechanical actuator device 40 on the corner units 10, hereinbefore described, may also be achieved by utilitzing the hydraulic device 100, as shown in FIG. 6. In such use the device 100 replaces the device 40. When utilizing the hydraulic device 100 the control unit body 34 is moved simply by the direction of flow of hydraulic fluid into or out of lines 116 and 118. A particular advantage flows from the use of hydraulically actuated device 100 in place of device 40 in that where four corner units 10 are employed in an assembly with four form panels 12, such as shown in FIGS. 1 and 7, the hydraulic devices 100 render it particularly easy to simultaneously withdraw the corner units 10 to their open position, as shown in FIG. 3.

It should be obvious from the above discussed apparatus embodiments that numerous other variations and modifications of the apparatus of this invention are possible and such will readily occur to those skilled in the art. Accordingly, the scope of this invention is not to be limited by the embodiments disclosed but is to include any such embodiments as may be encompassed within the scope of the claims appended hereto.

We claim:

1. Apparatus for use in casting a concrete inside corner wall structure comprising:

an elongated corner member defining an outwardly facing corner angle to extend lengthwise of the corner to be cast, said member providing outer edges facing generally normal to each other;

a pair of form panels disposed to define outwardly facing surfaces generally perpendicular to each other;

a control unit having a body and actuator means operable to move adjacent edges of said panels into abutment with said outer edges of said corner member preparatory to concrete pouring and to strip both of said form panels and said corner member from the concrete structure after such structure has hardened;

a control element affixed to said corner member and extending inwardly from said member, said control element being engaged with said actuator means; and four bar linkage means connecting said control unit to both of said form panels, said linkage means including parallel links disposed at opposite sides of said control unit body with each of said links having one end of the link pivotally connected to one of said panels and the other end of the link pivotally connected to said control unit body, said four bar linkage means having retaining means operable when said form panels have been stripped from the concrete structure to retain said linkage means against relative movement while said corner member is stripped by withdrawing force applied to said corner member through said control element, said retaining means including a retainer movable mounted on one portion of said linkage means and tab means fixedly mounted on another portion of said linkage means, said retainer being moved into retaining engagement with said tab mean when said linkage means is to be retained against relative movement.

2. Apparatus for use in casting a concrete inside corner wall structure comprising:

an elongated corner member defining an outwardly facing corner angle to extend lengthwise of the corner to be cast, said member providing outer edges facing generally normal to each other;

a pair of foam panels to be disposed to define outwardly facing surfaces generally perpendicular to each other;

a control unit having means movably connecting said unit to each of said form panels and to said corner member, said unit having actuator means acting through said connecting means to move adjacent edges of said panels into abutment with said outer edges of said member preparatory to concrete pouring and to strip both of said form panels and said corner member from the concrete structure after it has hardened;

said means for connecting said control unit to said corner member including a control element affixed to said corner member and extending inwardly from said member; said actuator means being engaged with said control element to move said panels and said corner member;

said actuator menas comprising a hydraulic actuator device providing a cylinder with a piston movable therewithin and wall means defining hydraulic fluid chambers on the opposite sides of said piston within said cylinder, said cylinder being affixed to the body of said control unit and said piston being connected to move with said control element by said piston being internally threaded and said control element being a threaded screw with which said piston is threadably engaged; and connecting means communicating with said chambers for introducing an exhausting hydraulic fluid relative to said chambers in effecting operation of said hydraulic actuator device.

* * * * *